United States Patent [19]

Dammann

[11] Patent Number: 4,662,832

[45] Date of Patent: May 5, 1987

[54] SCREW TYPE COMPRESSOR

[75] Inventor: Karl-Heinz Dammann, Bielefeld, Fed. Rep. of Germany

[73] Assignee: Technika Beteiligungsgesellschaft mbH, Fed. Rep. of Germany

[21] Appl. No.: 433,699

[22] Filed: Oct. 12, 1982

[30] Foreign Application Priority Data

Oct. 9, 1981 [DE] Fed. Rep. of Germany ..... 3140107

[51] Int. Cl.[4] ..... F04C 18/00

[52] U.S. Cl. ..... 418/201; 418/150; 74/458

[58] Field of Search ..... 418/150, 201, 202, 203, 418/220, 197; 74/458

[56] References Cited

U.S. PATENT DOCUMENTS 3,423,017 1/1969 Schibbye ..... 418/201

FOREIGN PATENT DOCUMENTS 254986 7/1926 United Kingdom ..... 418/201

OTHER PUBLICATIONS

Reutter, Fritz, *Descriptive Geometry,* Fifth Edition, Verlag G. Braun Press, Karlsruhe, pp. 158–173.

*Primary Examiner*—Carlton R. Croyle
*Assistant Examiner*—Jane E. Obee
*Attorney, Agent, or Firm*—Burns, Doane, Swecker & Mathis

[57] ABSTRACT

A parallel and outer axial rotating piston compressor has at least one helical main rotor and a corresponding auxiliary rotor meshing therewith. The main rotor includes a plurality of teeth, the flanks of which are configured as open screw surfaces defined by the screwing of a generating straight line, crossing the screw axis obliquely for each surface. The straight line forms a first inclination angle with a plane disposed perpendicular with the rotary axis of the main rotor. The screw surfaces define a throat screw line. A line tangent to the throat screw line forms a second angle of inclination of the plane. The first inclination angle is smaller than the second inclination angle. The slope of the generating straight line and the slope of the tangent line have opposite signs.

3 Claims, 9 Drawing Figures

SCREW TYPE COMPRESSOR

RELATED APPLICATION

Attention is directed to my concurrent filed application Ser. No. 433,700, entitled "Rotating Piston Compressor."

BACKGROUND AND OBJECTS OF THE INVENTION

The invention relates to a parallel and outer axial rotating piston compressor with at least one helical main rotor and correspondingly at least one auxiliary rotor meshing therewith.

Such a rotating piston compressor is known, e.g., from DE-OS No. 2 505 113, the disclosure of which is incorporated herein by reference. The Offenlegungsschrift deals in particular with the shape of the tooth surfaces of the auxiliary rotor, in order to keep the blow-hole of the compressor toothing as small as possible. This is achieved in that the contact line along which the tooth flanks of a tooth each of main and auxiliary rotors, respectively, of a tooth pair in engagement adjoin, does not reach to the housing edge which is produced by the section of the two housing bores (see also Rinder, Springer Verlag, Vienna, N.Y., 1979, p. 72 ff, which is also incorporated herein by reference).

Similarly, U.S. Pat. No. 2,622,787 deals with the reduction of leakage produced due to the blow-hole. The disclosure of this patent is also incorporated herein by reference.

These and other known rotating piston compressors have symmetrical and non-symmetrical tooth profiles composed of differently dimensioned curve segments which are mathematically often not uniformly definable. In general, the teeth are deeply cut in, see also Rinder, Screw Compressors, p. 28, FIG. 11, where the construction and build-up of a non-symmetrical rotor is described in more detail.

The rotors of screw compressors must be produced with the greatest precision possible to keep leakage as small as possible; thus, expensive and costly tools and tool machines are necessary. Due to the complicated shape of the individual profiles, special cutters are required and the production of a rotor demands several work steps (e.g., pre-cutting with so-called roughing cutters, and then finishing with finishing or fine cutters). A cutter set for a rotor pair can be expensive, the cost depending on the diameter. The cost for final inspection is added to this.

Rotating piston compressors are available on the market which have different output volumes to satisfy each desired requirement. Accordingly, the manufacturers offer compressor series wherein the distance between the steps is chosen relatively large because of the expensive production, so that not too many expensive tools must be produced and kept in storage. Consequently, the individual rotating piston compressor types of a series are not operated in their optimal region or near the optimal region but over a larger region. In FIG. 1, the specific rate of power input ($kW/m^3/min$) is plotted versus the output volume ($m^3/min$). On the abscissa, the circumferential speed of a rotor or its rotational speed could be plotted; this would change nothing of the qualitative statement. The optimal operational point lies at point A on the drawn curve, as can be seen in FIG. 1. The rotating piston compressors on the market run in the region BAC that is not exclusively in or near the optimal region, which would lie approximately at B'AC', in order to let the output volume stream of a type link-up with the next larger type without a gap. The expansion of the output amount region of each type must be achieved by variation of the rotational speed with transmission gears (belt or toothed-wheel gearing, or by regulation of the rotational speed of the drive motor). If one wanted to operate the rotating piston compressor in the region B'AC', the output volume stage would have to be decreased. But to achieve this as mentioned above, a larger number of rotating piston compressor types would be required and a larger number of expensive tools.

It is the object of the invention to create a rotating piston compressor of the initially described type which is easy to produce and which requires only relatively inexpensive tools for manufacturing the profiles. Furthermore, the dimensional control should be carried out precisely, economically and simply.

SUMMARY OF THE INVENTION

This task is solved according to the invention by providing that the tooth flanks of the main rotor are inclined open radial helicoids formed by the helical generation of a generating straight line, crossing the rotor axis obliquely for each plane, wherein the inclination angle of the generating straight line, whose plane is perpendicular to the screw axis has a smaller absolute value than the inclination angle of the tangent of the throat screw line with the plane and the slope of the generating straight line and the slope of the tangent to the throat screw line have opposite signs.

In a further embodiment of the invention, it can be provided that the tooth flanks of the auxiliary rotor are generated and determined by turning the main and auxiliary rotor against one another from the relative path of a point lying on the addendum line (main rotor head point).

Preferably, the main rotor has at least three teeth.

In the chosen profile according to the invention, the tooth flanks of the main rotor are not composed of curve segments but, because of the generating straight line, by a steady continuous, analytically definable curve-shape from head point to head point. The tooth flanks of the main rotor have the shape of oblique open screw surfaces (see Wunderlich, Descriptive geometry, Volume 2, pg. 176 ff, and especially pg. 183, point 97d). The generatrix for the main rotor is therefore a straight line and the flanks in a front section are formed by the symmetrical part of a helicoid. The main rotor therein can be produced by means of a plain-milling cutter in a roller cutting process. Because such a plain-milling cutter does not contact the screw surface exactly along a generating straight line but rather in a space curve, the profile shape of an inclined plain-milling cutter is not exactly a straight line but instead a curved line (profile cutter). On the other hand, the flank can be produced by means of planing, especially in planing or shaping by generating. Such methods are known and common in gear construction; they are more precise than a plain-milling method but require more time than the latter. In any case, the production of the main rotor is significantly cheaper and final inspecition of the main rotor is also simplified, and the simplification consists therein, that the main rotor can be measured with a simple measuring device, quasi two-dimensionally. Due to the simplified measuring device or the measuring method for final inspection, the tolerance band for the main rotor can be clearly reduced.

Due to smaller costs and simple geometry, a large variety of types is moreover possible, so that a rotating piston compressor series can be offered which has a finer graduation compared to known compressor series. An optimization of the efficiency of the individual rotating piston compressor of the series is possible by choosing optimal circumferential speeds with elimination of gears (gear wheels and pinions or belts adapted to the electrical standard rotational speed of, for example, a drive designed for an electromotor). The individual rotating piston compressor can be operated in direct drive mode in the B'AC' region (FIG. 1), so that the optimal work region can be exploited.

Due to the simplification of the profile, the geometry of the finished rotor is also easier to measure and final inspection can be more economical, as mentioned above. The individual rotating piston compressor of such a series can be driven directly as mentioned above, without insertion of an intermediate set of gears, so that an improvement in efficiency can be hereby achieved.

A further advantage of the embodiment according to the invention consists in the following: in known rotors, the tooth depth, i.e., the groove depth between the neighboring addendum lines is large. This results in a ratio of core diameter to outer diameter that is also large. In known rotors, this value lies between 0.4 and 0.5. In the rotor according to the invention defined by the features of the characterizing clause of claim 1, the ratio of core diameter to outer diameter is approximately 0.95. The expected bending-through of the main rotor according to the invention compared to known main rotors is practically 0. Therefore, the tolerances can be held very small and moreover the main rotor is very robust. Due to these tolerances the efficiency can be additionally improved.

THE DRAWING

The invention as well as further advantageous embodiments and improvements of the same will be explained and described in more detail with regard to the drawing wherein an embodiment of the invention is represented:

DETAILED DESCRIPTION OF A PREFERRED EMBODIMENT OF THE INVENTION

Figure 1:
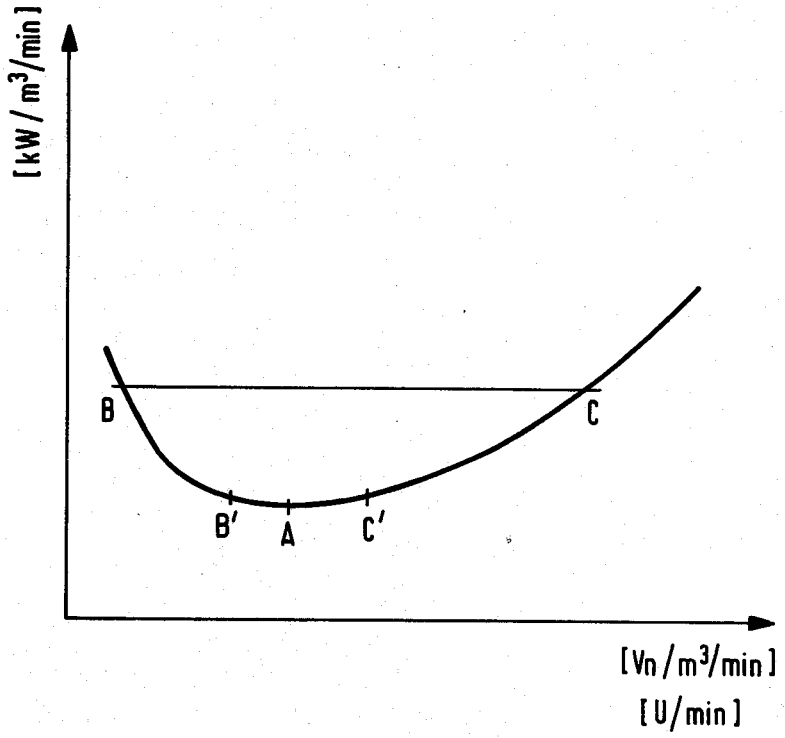
FIG. 1 shows a diagram, in which the specific performance requirement in $kW/m^3/min$ is plotted versus an output amount in $m^3/min$.
Figure 2:
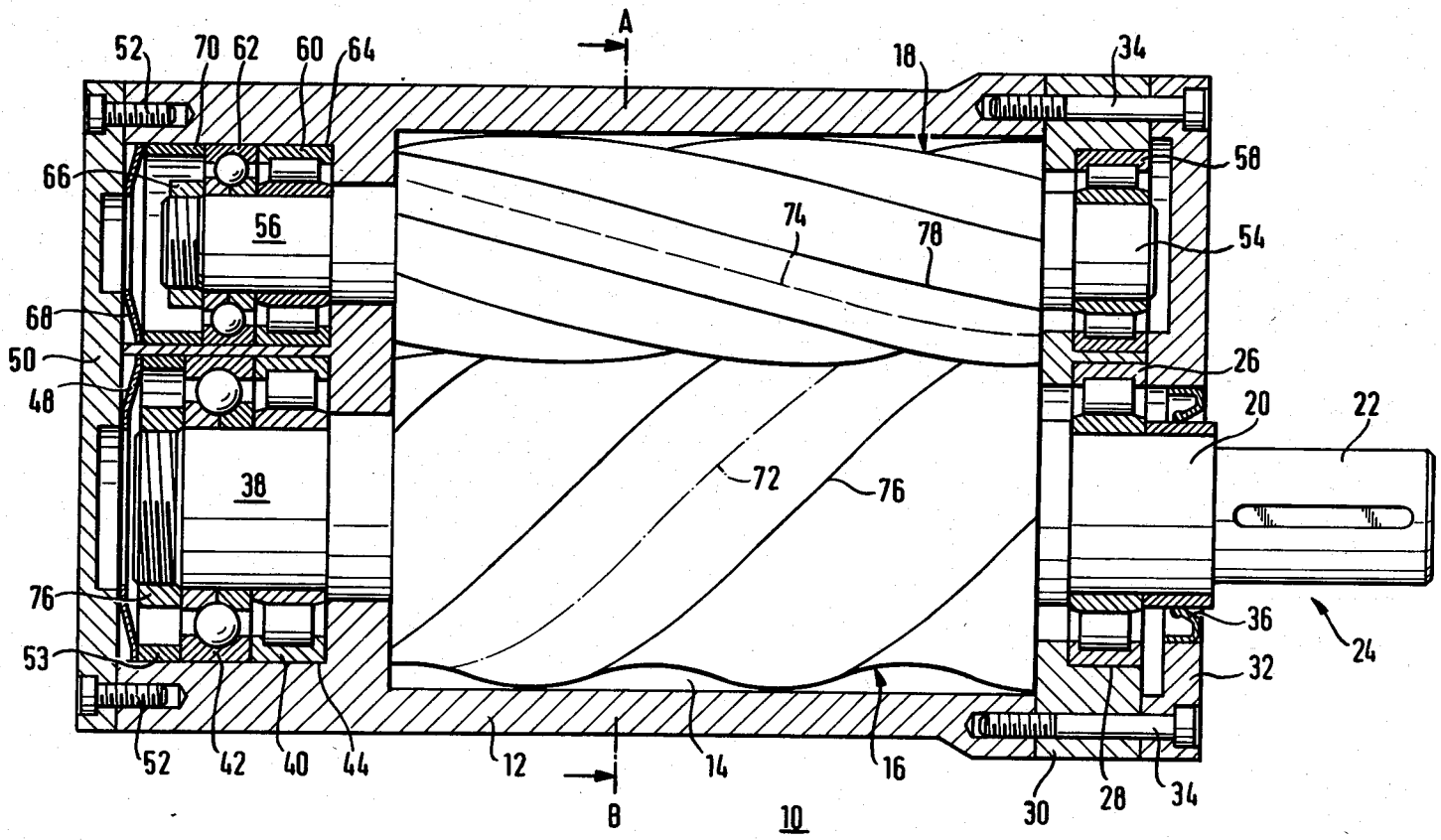
FIG. 2 is a longitudinal section of a rotating piston compressor according to the invention.

Attention is called first to FIG. 2. The rotating piston compressor 10 has a compression chamber 14 in a housing 12 wherein a main rotor 16 and an auxiliary rotor 18 meshing therewith are arranged. The main rotor 16 has an extension 24 at one end which is divided into two parts 20 and 22 with different diameters, of which one part 20 with the larger diameter serves for support within roller bearings 26, and the other part 22 with a smaller diameter serves for connection of a drive (not shown). The bearing 26 is located in a bearing opening 28 in a bearing disk 30 which is firmly connected with the housing 12 with a closure lid 32 by a screw connection 34. A sealing ring 36 is provided for sealing of bearing 26 to the outside.

At the opposite end, the main rotor 16 has another bearing pin 38 which is supported in a roller bearing 40 and a ball bearing 42 in a first bearing opening 44 of a housing 12. The attachment of bearings 40 and 42 is achieved on the inside by a nut 46 screwed onto bearing pins 38 and on the outside by a pressure spring 48 which is supported by a second closure lid 50 which is firmly connected with the housing by screw bolts 52 with insertion of a fixing jacket 53.

In a similar fashion, the auxiliary rotor 18 has bearing pins 54 and 56. The bearing pin 54 is supported in a roller bearing 58 in the bearing disk 30. The bearing pin 56 is supported in a roller bearing 60 and a ball bearing 62 in a second bearing opening 64 in housing 12. The attachment or axial fixation of the bearings 60, 62 is achieved at the inner diameter or inner race (ring) of the bearings by a screwed-on nut, and at the outside diameter or support outer race by a fixing jacket 70 which is urged against the outer race by a spring 68.

Reference numeral 72 refers to the line of striction of the main rotor which line of striction is represented by a dash-dot line. The reference numeral 74 refers to the throat of the auxiliary rotor i.e., a line defined by the minimum radial distance from the longitudinal axis of the auxiliary rotor. The reference numerals 76 and 78 refer to the head lines of the main and auxiliary rotors, respectively i.e., the lines defined by the maximum radial distance from the rotor axes.

Figure 3:
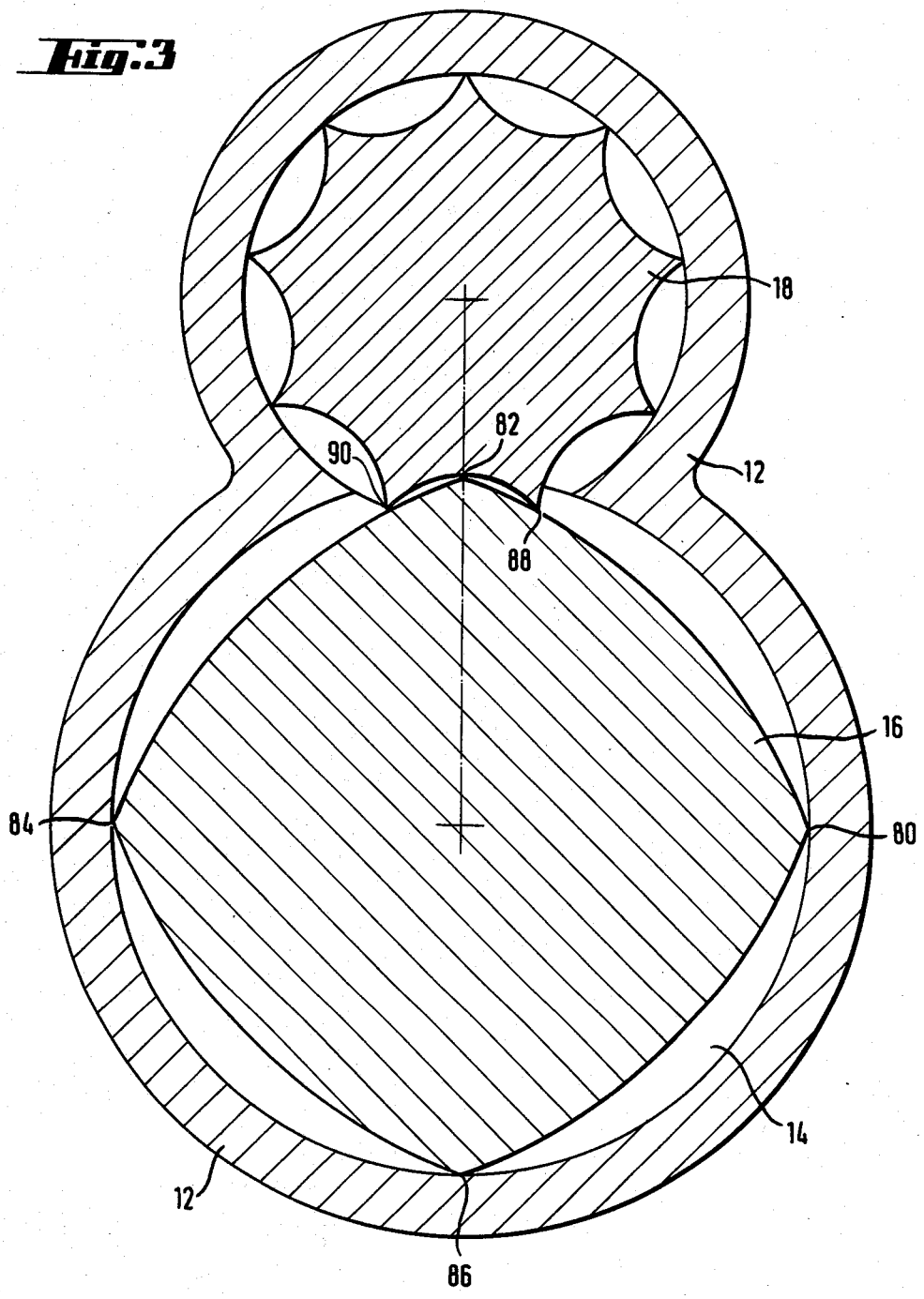
FIG. 3 is a longitudinal section along line III—III of FIG. 1.

In FIG. 3, a cross-section along line A–B of FIG. 2 is shown. The main rotor 16 has a total of four teeth, the head points of which are indicated in the section according to FIG. 3 by the reference numerals 80, 82, 84 and 86. The teeth are formed by an oblique, open screw surface or helicoid. The generatrix of this screw surface which forms a screw with a circumferential curve between the head points 80-82; 82-84; 84-86 and 86-80, is a straight line G which is obliquely disposed relative to the screw axis S (see FIG. 8A). The angle of inclination $\alpha$ which the straight line forms with the plane E-E (which is perpendicular to the screw axis), is absolute, i.e., with respect to the numerical value, $\alpha$ is smaller than the inclination angle $\beta$ of the throat screw line 72 of the corresponding profile, and the slope of the straight line G has the opposite sign relative to the slope of the throat screw line 72.

The auxiliary rotor 18 has nine teeth (which are not individually numbered) wherein, as can be seen in FIGS. 4 to 7, the tooth flanks between the teeth are determined by the relative path of the head points 80 to 84 of the main rotor 16. Actually, the auxiliary rotor tooth flanks are not precisely shaped as circles in the case of sharply pointed auxiliary rotor teeth, but rather as twisted epitrochoids which can be, however, substituted by curvature circles, i.e., by circular arcs.

Figure 4:
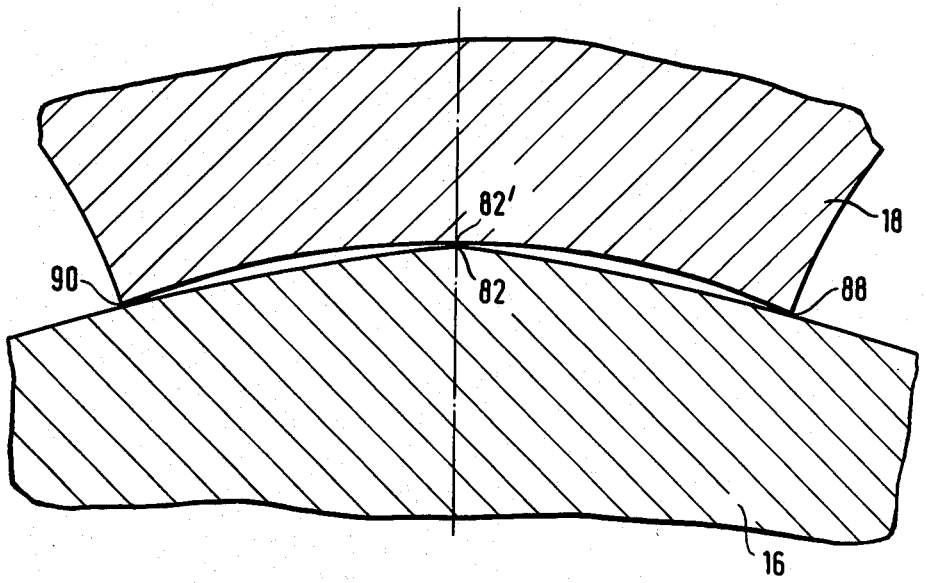
FIGS. 4–7 are representations of the arrangement of the main and auxiliary rotor in different positions relative to another.
Figure 5:
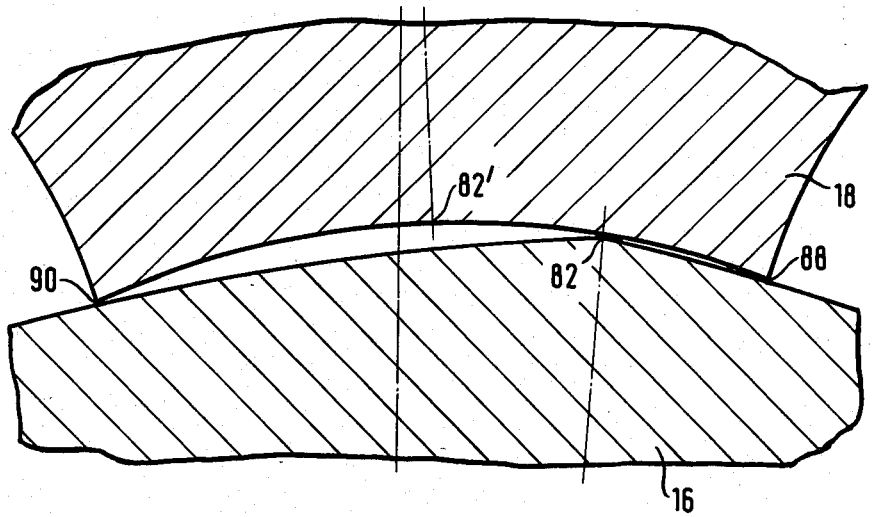
Figure 6:
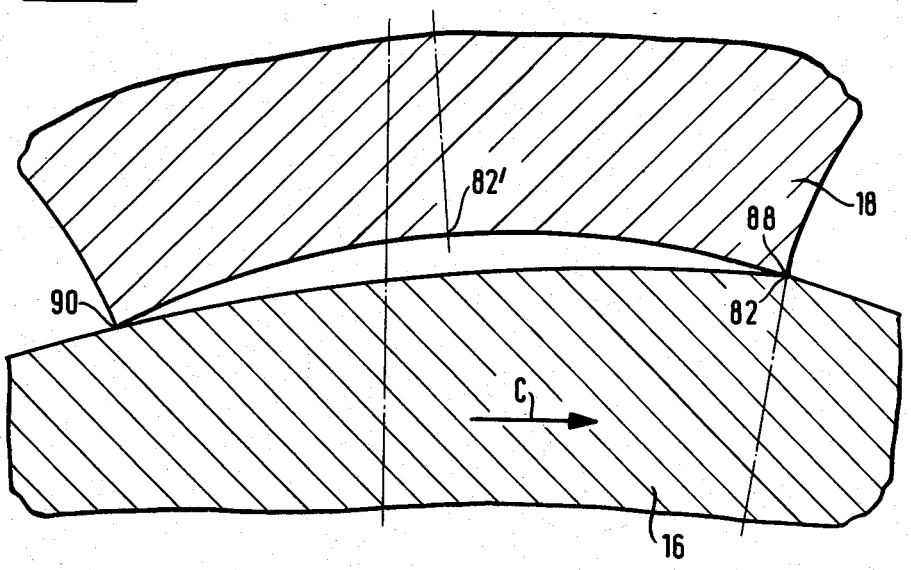

FIG. 4 shows a first position of the main and auxiliary rotors relative to one another, wherein the head point 82 of the main rotor 16 in the position shown, i.e., the head point center line, lies exactly on the connecting line V—V of the central axes of the rotors. The head point 82 is flush with the throat point 82' of the auxiliary rotor 18, which also lies on the connecting line V—V between the center axes of both rotors. In this case, the head point center line and the throat point center line fall together. The head points 88 and 90 of the auxiliary rotor 18 lie exactly on the tooth flank of a tooth which has the head point 82. If the main rotor is turned in the direction of arrow C, the head point center line is moved clockwise relative to the auxiliary rotor (downwards in FIG. 5) and the head point 82 comes to rest on the tooth flank of the auxiliary rotor, whereby it can be seen that the tooth flank of the auxiliary rotor is determined by the path of the head point 82. Head point 90 of the auxiliary rotor 18 is still resting on the other tooth flank. The throat point center line 82' of auxiliary rotor 18 has moved counter-clockwise (about its own axis) by a lesser amount corresponding to the differential rate of rotational speed between main and auxiliary rotors. Both the throat point center line 82' and the head point 82 are not spaced from the connecting line V—V of the center points of the two rotors.

Figure 7:
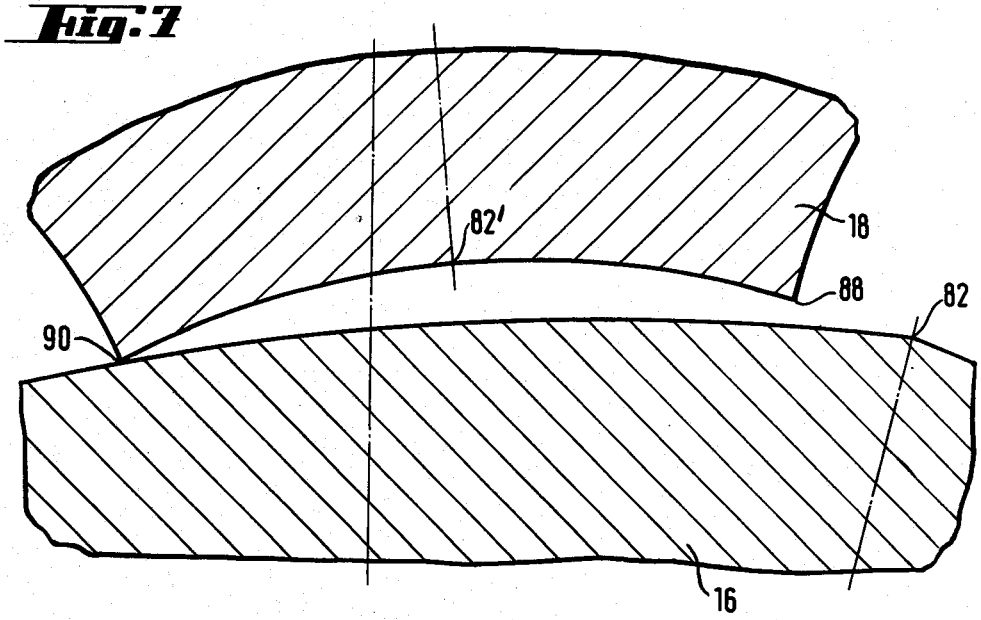

After further rotation, (FIG. 6), the head point 82 of the main rotor is in the region of the head point 88 of the auxiliary rotor, and the head point 90 still rests on the tooth flank of the main rotor. In FIG. 7, one recognizes that the head point 82 has freed itself from the auxiliary rotor, but head point 90 is still resting on the tooth flank. In turning further, the next head point 84 of the main rotor engages the auxiliary rotor and the process or the geometry, respectively, is the same as in FIGS. 4 to 7: the tooth flanks of the auxiliary rotor are defined by each respective head point of the main rotor and when a head point of a main rotor is situated between two head points of an auxiliary rotor, the head points of the auxiliary rotor rest on the tooth flank or tooth flanks, respectively, of the main rotor.

Figure 8A:
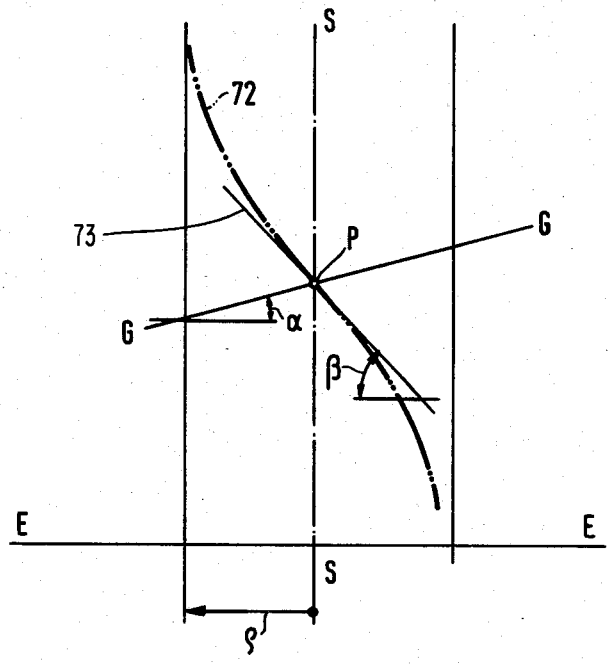
FIGS. 8A and 8B is a schematic representation of geometric relationships to illustrate some concepts on the main rotor.
Figure 8B:
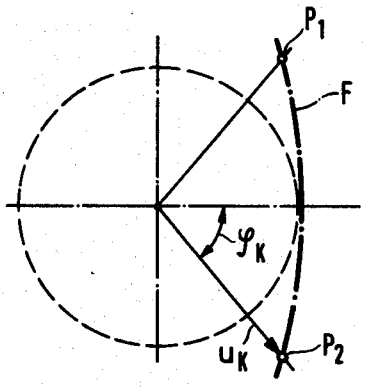

Reference is made to FIGS. 8A, 8B. A screw axis S—S is shown therein, and a plane E—E which is perpendicular to it. The radius of the throat screw line 72 is referenced by p and its projection intersects the screw axis at point P. The generating straight line G—G forms an angle $\alpha$ with E—E. The line 73 tangent to the throat line 72 forms an angle $\beta$ with the plane E—E at point P. The angle $\alpha$ is absolute, that is, smaller than the angle $\beta$ with respect to its value; the inclination of both angles have opposite signs, however.

The flank front face section curve of the screw surface generated by the straight line G—G lies between two points $P_l$ and $P_2$, and has the designation F (see FIG. 8B) which can be derived from its generation as an involute. The head circle radius $u_\mu$ and the angle $l_\mu$ which is assigned to each head point in each section have been determined numerically by iteration due to the complexity of the method of calculation and an explicit closed representation is practically not possible.

Because the tooth flanks of the auxiliary rotor are defined by the head point of the main rotor in the case of sharply pointed auxiliary rotor teeth, an explicit calculation of the tooth flanks of the auxiliary rotor is possible by computation with a computer.

Due to the profile shape of the main and auxiliary rotors, the blow-hole can be made practically null. This is a further special advantage of the embodiment according to the invention, and for this reason the profile shape is especially well suited for small output volumes where even small leakages can lead to a clear reduction in efficiency.

Although the present invention has been described in connection with preferred embodiments thereof, it will be appreciated by those skilled in the art, that additions, modifications, substitutions, and deletions may be made, without departing from the spirit and scope of the invention, as defined in the appended claims.

WHAT IS CLAIMED IS:

1. A parallel and outer axial rotating piston compressor of the type having at least one helical main rotor and a corresponding auxiliary rotor meshing therewith, said main rotor including a plurality of teeth, the flanks of which being configured as oblique open radial helicoid surfaces defined by the helical generation of a generating straight line crossing the screw axis obliquely as viewed in a radial direction with reference to said axis, and straight line forming a first inclination angle with a plane disposed perpendicular with the rotary axis of the main rotor, said screw surfaces defining a throat line, a line tangent to said throat line forming a second angle of inclination with said plane, said first inclination angle being smaller than said second inclination angle, the slope of said generating straight lline and the slope of said tangent line having opposite signs.

2. Rotating piston compressor according to claim 1, wherein said teeth of said main rotor each include, in cross-section, a head point having the greatest distance from said axis, said auxiliary rotor includes tooth surfaces which are defined by the travel path of a point lying on the main rotor head point during the relative rolling motion of the main rotor and auxiliary rotor.

3. Rotating piston compressor according to claim 1, wherein the main rotor has at least three teeth.

* * * * *